US006405902B2

(12) United States Patent
Everett

(10) Patent No.: US 6,405,902 B2
(45) **Date of Patent: *Jun. 18, 2002**

(54) QUICK CHANGE, MICRO DISPENSING TIP WITH DISPOSABLE LINER

(76) Inventor: Alan L. Everett, 12928 Big Treet Rd., East Aurora, NY (US) 14052

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/360,972

(22) Filed: Jul. 27, 1999

Related U.S. Application Data

(60) Provisional application No. 60/094,302, filed on Jul. 27, 1998.

(51) Int. Cl.[7] ..... B05B 1/02

(52) U.S. Cl. ..... 222/214; 222/504; 222/567; 239/600

(58) Field of Search ..... 222/214, 504, 222/567; 239/391, 591, 600; 251/5, 7

(56) References Cited

U.S. PATENT DOCUMENTS 5,199,649 A * 4/1993 Tolboll ..... 239/600
5,253,807 A * 10/1993 Newbegin ..... 239/600 X
5,487,507 A * 1/1996 McDonald et al. ..... 239/600 X
5,524,829 A * 6/1996 Keim et al. ..... 251/5 X
5,938,079 A * 8/1999 Wacker et al. ..... 222/214 X

* cited by examiner

*Primary Examiner*—Kenneth Bomberg
(74) *Attorney, Agent, or Firm*—Hodgson Russ LLP

(57) ABSTRACT

A quick change micro dispensing tip with disposable liner for dispensing liquid such as viscous and non-viscous adhesives in electronic component assembling. A multi-pin, positioning and locking mechanism attaches the dispensing tip to the dispensing pump. This feature increases the positioning accuracy and repeatability of coupling the tip of the pump. Additionally, the time is decreased in the coupling the tip and pump. Therefore, there exists minimal malfunction due to misalignment of pump with tip. The disposable inner liner of the quick change, micro tip is a simplified, disposable intermediary passage for the adhesive through the coupled dispensing tip with pump. This liner comprised of non-adhesive compatible, disposable material, is captive and supported by the shell of the quick change micro tip. Therefore, the liner does not require the strength necessary in current tips by incorporate the disposability necessary for cost reduction and rapid change overs between operations.

16 Claims, 7 Drawing Sheets

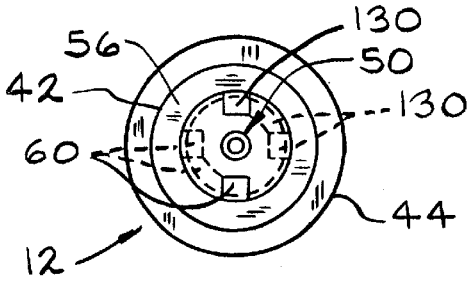
FIG. 6
FIG. 7
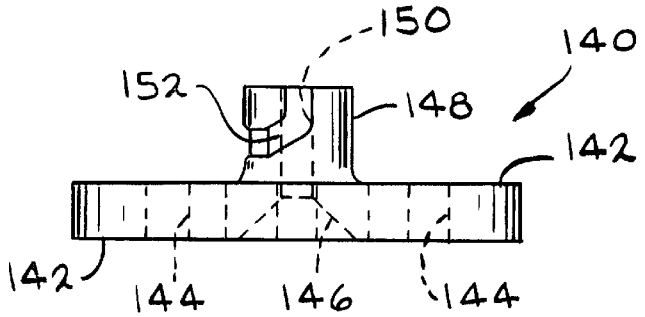
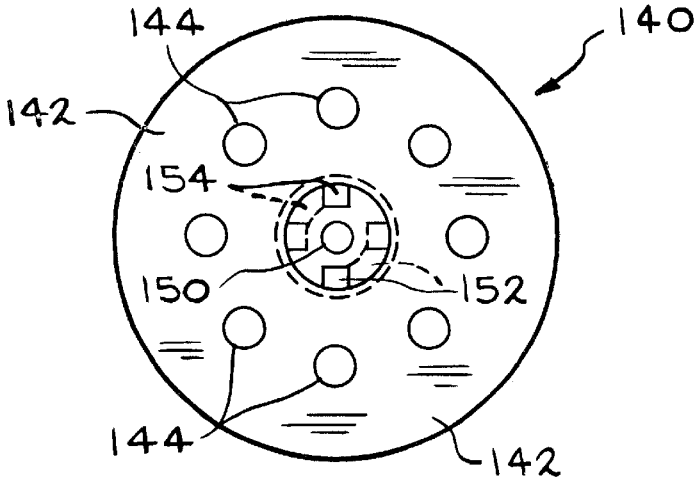
FIG. 8

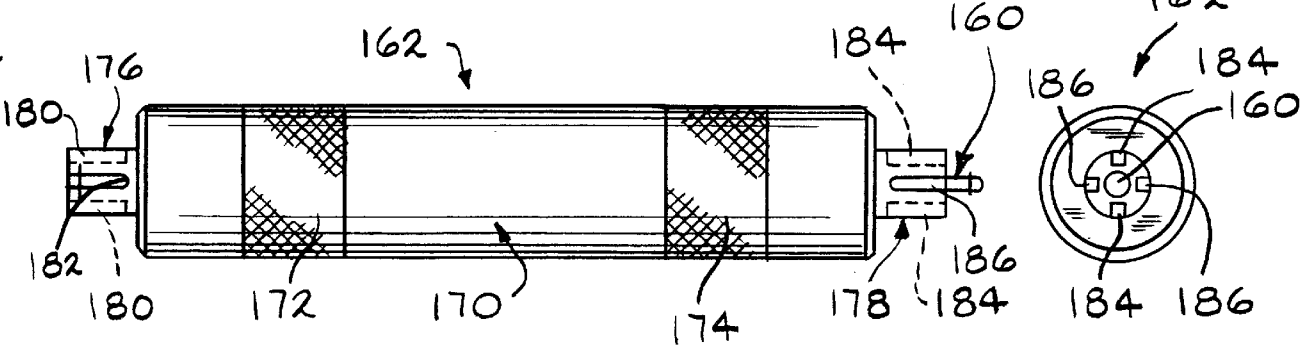
FIG. 12
FIG. 14
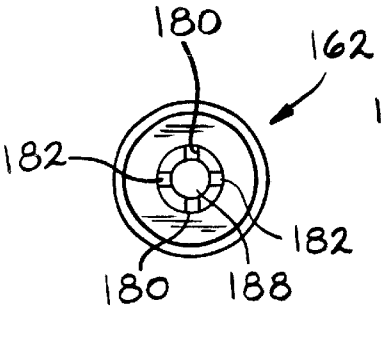
FIG. 13

QUICK CHANGE, MICRO DISPENSING TIP WITH DISPOSABLE LINER

CROSS-REFERENCE TO A RELATED APPLICATION

Applicant hereby claims priority on earlier filed provisional patent application Ser. No. 60/094,302 filed Jul. 27, 1998 and entitled "Quick Change, Micro Dispensing Tip With Disposable Liner" which is incorporated herein by reference.

BACKGROUND OF INVENTION

This invention relates to the art of apparatus for dispensing liquids such as adhesives, and more particularly to a new and improved micro dispensing tip for use with apparatus for dispensing such liquids.

Due to the miniaturization increase in electronic technology, various viscous and non-viscous adhesives were developed to adhere component assemblies (i.e. circuit boards, connectors, chips). Positive displacement pumps and the like were designed to apply the electronic adhesives. Some pumps interface with programmable controllers enabling accurate, multi-positioning, and rapid dispensing of the adhesives. Positioning and dispensing accuracies are vital to this electronic technology.

Micro dispensing of the electronic adhesive has been accomplished by means of disposable, hypodermic needle, dispensing tips. An example of a dispensing tip is shown in U.S. Pat. No. 4,572,103 issued Feb. 25, 1986, the disclosure of which is hereby incorporated by reference. The dispensing tips fasten to the dispensing pump using a "Leur" thread lock. These tips are very precise which translates to high costs. Currently, all dispensing tips are very difficult to clean of the electronic adhesive during and between application processes. Thus, the tips are disposed of, adding to the cost of such electronic component assembly processes.

In addition to the tips cleaning problem, compromises in the accuracy of the thread lock systems have been necessitated in an effort to lower costs on the disposable tips. Thus, the dispensing accuracy is compromised.

SUMMARY OF THE INVENTION

The present invention provides a quick change micro dispensing tip with disposable liner for dispensing liquid such as viscous and non-viscous adhesives in electronic component assembling. A single pin or multi-pin, positioning and locking mechanism attaches the dispensing tip to the dispensing pump. This feature increases the positioning accuracy and repeatability of coupling the tip to the pump. Additionally, the time is decreased in the coupling between the tip and pump. Therefore, there exists minimal malfunction due to misalignment of pump with tip. The disposable inner liner of the quick change, micro tip is a simplified, disposable intermediary passage for the adhesive through the coupled dispensing tip with pump. This liner comprised of disposable material, non-reactive with the adhesive, is captive and supported by the shell of the quick change micro tip. Therefore, the liner does not require the strength necessary in current tips but incorporates the disposability necessary for cost reduction and rapid change overs between operations.

The following detailed description of the invention, when read in conjunction with the accompanying drawings wherein the same reference numerals denote the same or similar parts throughout the several views, is in such full, clear, concise and exact terms as to enable any person skilled in the art to which it pertains, or with which it is mostly nearly connected, to make and use the invention.

BRIEF DESCRIPTION OF THE DRAWINGS

FIG. 6 is an end elevational view of the adaptor shown in FIG. 5;

FIG. 7 is a side elevational view of an alternative form of adaptor;

FIG. 8 is a plan view thereof;

FIG. 12 is a side elevational view of the tool shown in FIGS. 9–11;

FIG. 13 is an elevational view of one end thereof;

FIG. 14 is an elevational view of the opposite end thereof; and

DETAILED DESCRIPTION OF THE PREFERRED EMBODIMENTS

Figure 1:
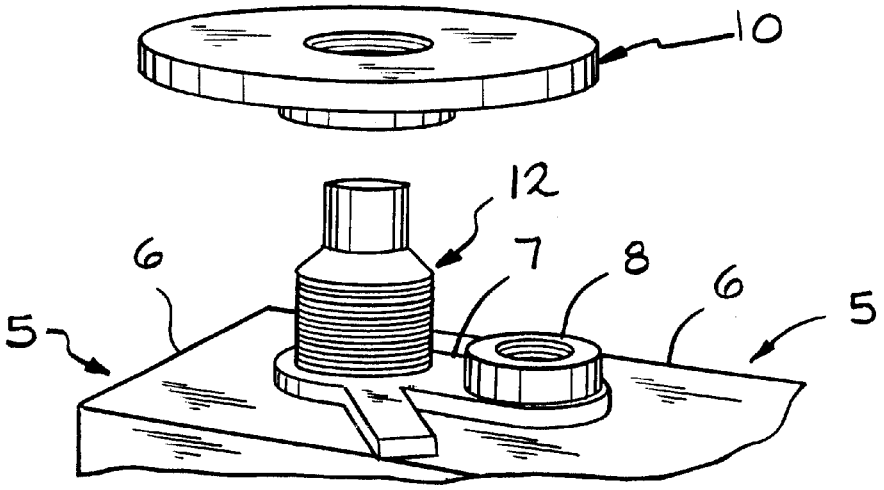
FIG. 1 is a perspective view illustrating one stage in the installation of the quick change tip of the present invention.
Figure 2:
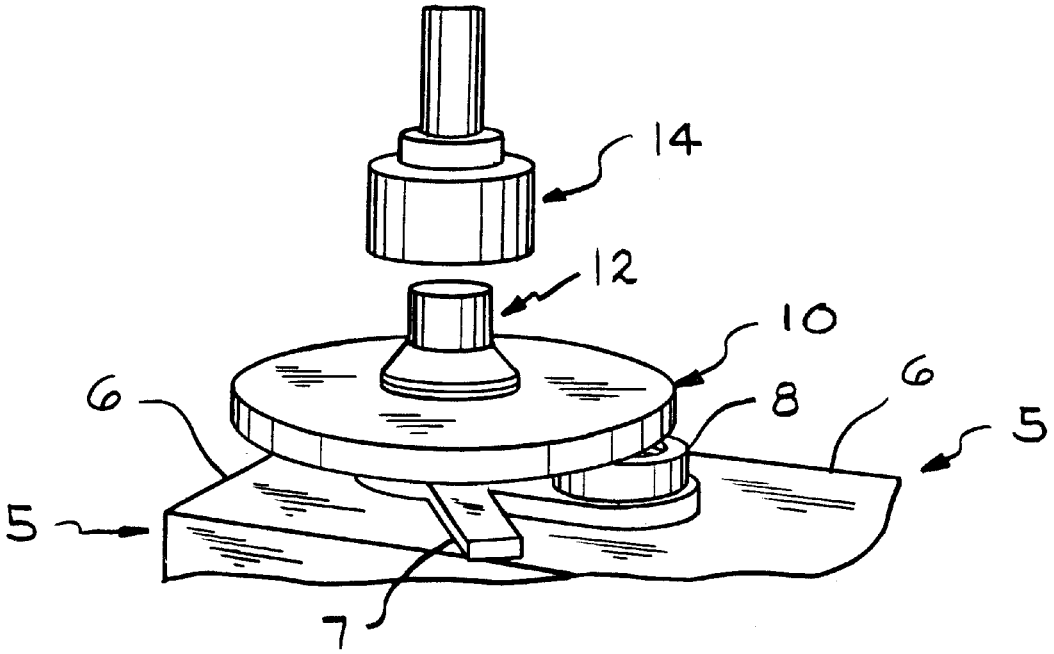
FIG. 2 is a perspective view illustrating another stage in the installation of the quick change tip of the present invention.

Referring first to FIGS. 1–4 there is shown a multi-pin, positioning and locking mechanism which attaches the dispensing tip according to the present invention to a dispensing pump 5. The housing of pump 5 has an end surface 6 in which an outlet port or passage (not shown) is provided, and an adapter 12 having an internal longitudinal through passage is in fluid flow communication with the outlet port. Adapter 12 is held in place by the combination of a lock arm 7 and screw 8 in a manner which will be described. As shown in FIGS. 1 and 2, a quick change tip stiffening cap 10 is rotated on the adapter 12 counter-clockwise until the cap stops. The stiffening cap is needed to help stiffen the quick change tip assembly. The assembly of this embodiment will not work without locking the stiffening cap 10 in place. Next, as shown in FIG. 2, a quick change tip 14 with the quick change tip seal of the present invention installed (not shown in FIGS. 1–4) is placed on the quick change tip adapter 12 by engaging pins on the tip 14 with slots, i.e. two slots, in the adapter 12, all in a manner which will be shown and described in further detail presently.

Figure 3:
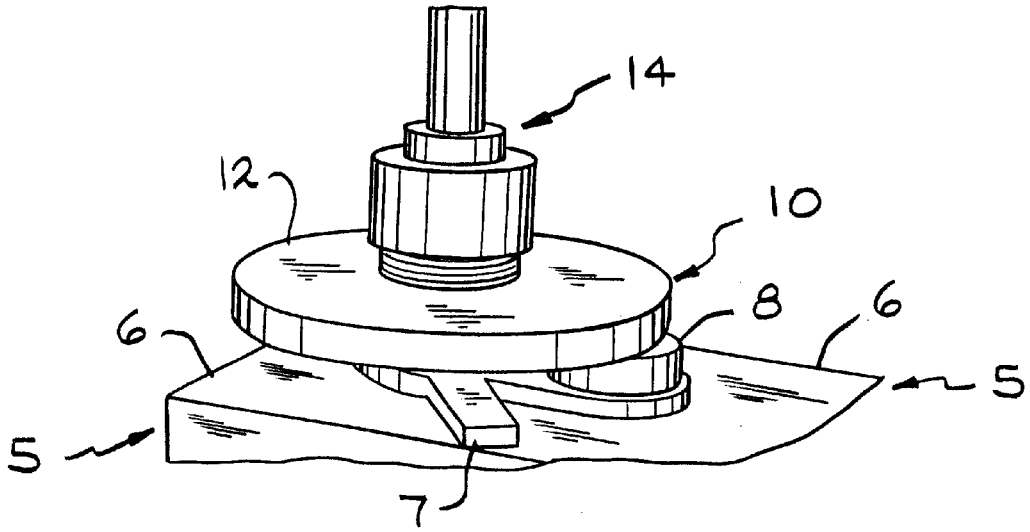
FIG. 3 is a perspective view illustrating another stage in the installation of the quick change tip of the present invention.
Figure 4:
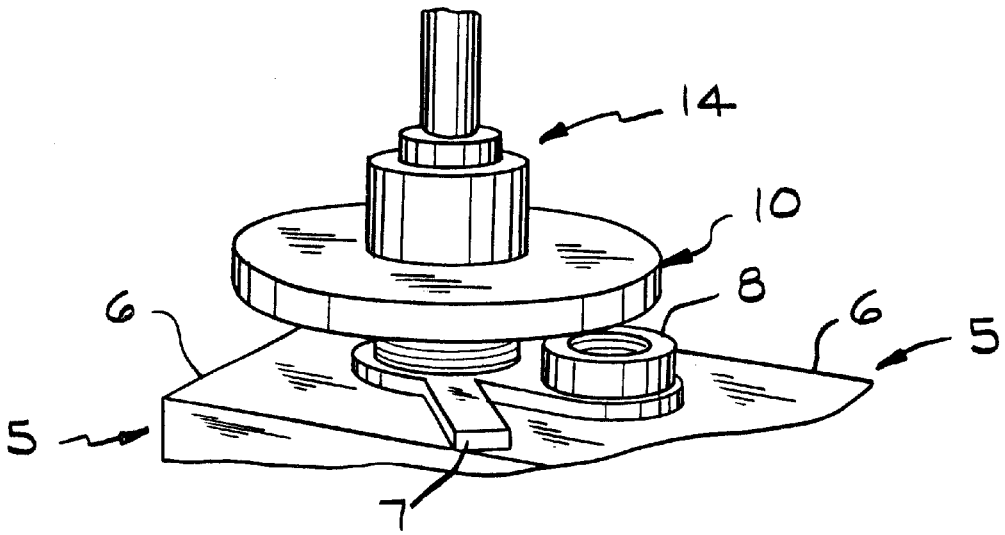
FIG. 4 is a perspective view illustrating another stage in the installation of the quick change tip of the present invention.

As shown in FIG. 3, the quick change tip 14 is pressed lightly on the quick change adapter 12 until the pins prevent further insertion of the tip on the adapter. Slight pressure is maintained and then the quick change tip 14 is rotated approximately ¼ turn clockwise on the quick change tip adapter 12. The quick change tip 14 is locked on the adapter 12 by rotating the quick change tip adapter stiffening cap 10 clockwise as shown in FIG. 4 until the stiffening cap 10 contacts the tip 14. There should be no gap between the tip 14 and stiffening cap.

Thus, the multi-pin, positioning and locking mechanism illustrated in FIGS. 1–4 attaches the dispensing tip 14 to the dispensing pump. This feature increases the positioning accuracy and repeatability of coupling the tip 14 to the pump. Additionally, the time is decreased in coupling the tip and pump together. Therefore, there exists minimal malfunction due to misalignment of pump with tip.

Figure 5:
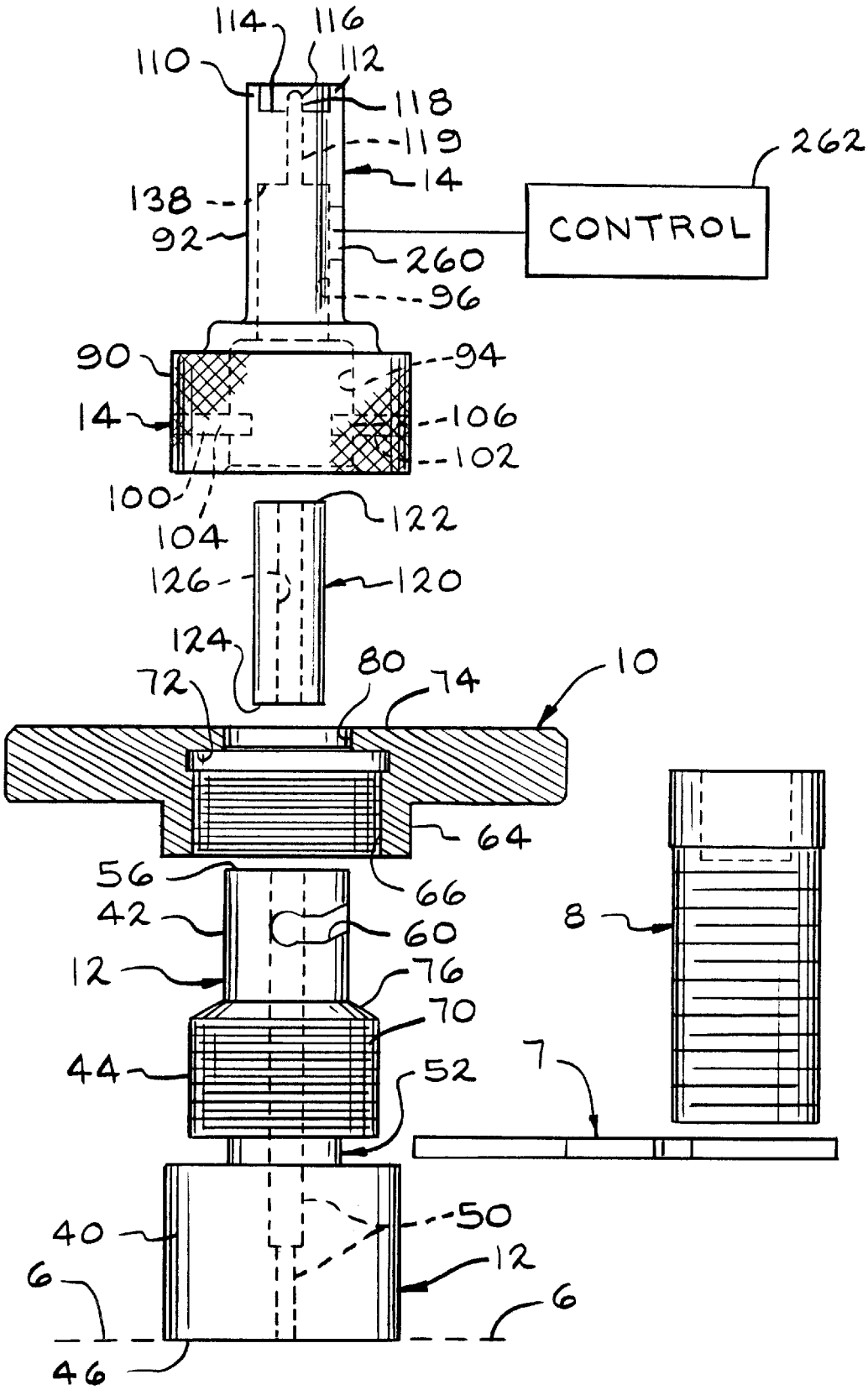
FIG. 5 is a developed elevational view further illustrating the apparatus of FIGS. 1–4.

The foregoing is illustrated in further detail by the developed view of FIG. 5. Adapter 12 has a first cylindrical body portion 40, a second, smaller diameter cylindrical body portion 42 and a third body portion 44 of intermediate diameter axially between portions 40 and 42. Body portion 40 has a smooth, flat end surface 46 which contacts end surface 6 of pump housing 5. Adapter 12 has a longitudinal through bore or passage 50 which communicates with the pump outlet opening or port in surface 6. Adapter 12 is held in place by arm 7 having one end which locks in an annular recess 52 between adapter body portions 40 and 44 and which arm 7 has an opposite end provided with an opening to receive the shank of screw 8 which is connected in pump housing 5. Other arrangements can of course be employed for securing the adapter to the pump at the location of the pump outlet.

The adapter body portion 42 terminates in a smooth, flat end surface 56. Body portion 42 is provided with a pair of grooves or tracks, one of which is designated 60 in FIG. 5, to receive pins of tip 14 in a locking relationship, much like a bayonet connecting arrangement, which will be described in further detail presently. Cap 10 is provided with an annular, bosslike extension 64 on one surface thereof, the inner surface of which is provided with threads 66 which extend further axially into the body of cap 10. The threads 66 in cap 10 engage threads 70 on the outer surface of adapter intermediate body portion 44 when cap 10 is rotated counter-clockwise on adapter 12 as described in connection with FIG. 1. This rotation of cap 10 is stopped by engagement between an inner annular seat 72 defined within cap 10 between threads 66 and the major end surface 74 of cap 10 and an annular step 76 defined between adapter body portions 42 and 44. A central opening 80 extends between the interior of extension 64 and cap surface 74 and is of a diameter to receive adapter body portion 42.

Dispensing tip 14 has a first cylindrical body portion 90 and a second, smaller diameter body portion 92 extending axially therefrom. Body portion 90 has an interior region 94 which meets the slightly smaller diameter interior region 96 of body portion 92. The wall of body portion 90 is provided with diametrically opposite bores 100, 102 which have a common axis extending perpendicular to the longitudinal axis of tip 14. A pair of pin-like members 104 and 106 are fixed in bores 100 and 102, respectively, and extend into the interior region 94. The pins 104, 106 are received in the tracks or slots, i.e. track 60, during the insertion and¼ turn motion described in connection with FIG. 3 when tip 14 is connected to adapter 12.

The end of tip body portion 92 has a pair of extensions or feet 110, 112 defining therebetween a recessed end region 114 containing the tip 116 of a nozzle 118 formation, the opposite end of which is in communication with interior region 96 via a passage 119. Feet 110, 112 contact the surface to which adhesive is to be applied and space nozzle tip 116 a short distance from the surface so that the small quantity or dot of adhesive can leave nozzle tip 116 and be applied properly to the surface. In addition, nozzle tip 16 is chambered to help form the dot of adhesive material leaving the nozzle and to facilitate removal of the dot of material from the nozzle tip. More than one nozzle and various feet configurations can be employed as will be shown and described presently.

By way of example, in an illustrative dispensing tip, the opening at the end of nozzle tip 116 can range in diameter from about 0.003 inch to about 0.033 inch depending upon the nature of the material being dispensed and the desired size of the dot of material leaving nozzle tip 116. The outer diameter of nozzle 118 can range from about 0.012 inch to about 0.050 inch and nozzle 118 typically can be about 0.121 inch in length. The distance between a plane passing through the end of nozzle tip 116 and a plane coincident with the end surfaces of the feet or standoffs 110, 112 can range from about 0.003 inch to about 0.020 inch again depending upon the nature of the material being dispensed and the desired size of the dot of material leaving nozzle tip 116. The chamfer angle on nozzle tip 116 typically is about 70° measured between a plane normal to the longitudinal axis of nozzle 118 and the chamfered surface. Interior region 94 can have a diameter of about 0.164 inch, interior region 96 can have a diameter of about 0.0938 inch and tip 14 can have an overall length of about 0.537 inch.

The disposable inner liner 120 of the dispensing tip of the present invention also is shown in FIG. 5. Liner 120 is in the form of a cylindrical body having a diameter enabling it to fit snugly but removably within the interior region 96 of body portion 92. This snug fit provides a fluid seal between the outer surface of liner 120 and the surface of region 96. The axial length of liner 120 between end faces 122 and 124 preferably is slightly greater than the axial length of region 96. Liner 120 is provided with a longitudinal central passage 126 through which the adhesive or other liquid being dispensed flows toward nozzle 118. The diameter of passage 126 can be varied depending upon the nature of the material flowing therethrough. The material of liner 120 is selected to be both impervious to and unreactive with the adhesive or other liquid flowing therethrough. A preferred material is virgin Teflon. Other materials can be employed such as polyethylene or polypropylene depending upon the nature of the adhesive or other liquid flowing therethrough. When the tip assembly is completed, as illustrated in FIG. 4, liner end surface 122 contacts the surface 130 of tip interior region 96 and liner end surface 124 contacts end surface 56 of adapter body portion 42. The material of liner 120 is selected to have some elasticity to enhance the sealing action between liner surface 122 and 124 and the surfaces 130 and 56, respectively, as well as the previously mentioned sealing in a radial outward direction against the surface of region 96.

Referring now to FIG. 6 there is shown an end view of adapter 12 which further illustrates the grooves or tracks, i.e. groove 60 shown in FIG. 5 and the diametrically opposite track 130 shown in FIG. 6. As can be seen from FIGS. 5 and 6, the grooves 60 and 130 are formed in the wall of adapter body portion 42 and both extend along a substantially J-shaped path to accommodate the initial longitudinal movement (relative to the longitudinal axis of adapter 12) of pins 104 and 106 along grooves 60 and 130, respectively, followed by the ¼ turn or twisting motion described in connection with FIG. 4. Each groove or track 60, 130 includes a first portion of major length extending along the wall of adapter 12 generally longitudinally thereof and a second portion of minor length extending at an angle, i.e. substantially at a right angle, to the first portion and somewhat in a circumferential direction along the wall and terminating in a slightly enlarged end of substantially circular configuration to accommodate the corresponding pin.

Adapter 12 can have various forms, and an alternative embodiment is shown in FIGS. 7 and 8 wherein the adapter 140 thereof has a disc-like body portion 142 provided with a series of apertures 144 to receive bolts or similar fasteners to secure adapter 140 to the end of a pump. A central, inwardly tapering opening 146 is aligned with the pump outlet port (not shown). Adapter 140 has a central, boss-like extension 148 from body portion 142 and has a smaller diameter internal longitudinal passage 150. Tracks or grooves 152 and 154 formed in extension 148 are similar to and serve the same purpose as tracks or grooves 60 and 130 previously described in connection with adapter 12.

In the various forms of adapter, the combination of grooves in the wall of the adapter and pins in the dispensing tip is preferred, because it provides the advantages of positioning accuracy, repeatability of coupling the tip to the pump, decreased time in coupling the tip to the pump and minimal malfunction due to misalignment between the tip and the pump. However, if one chooses, alternative forms of coupling or locking arrangements between the adapter and the tip can be employed. For example, the grooves could be provided on the dispensing tip and the pins on the adapter. As an alternative to the pin and groove arrangement, a threaded connection could be provided between the dispensing tip and the adapter. Other mechanical locking or coupling arrangements can of course be employed.

The disposable inner liner 120 of the quick change, micro dispensing tip 14 of the present invention is a simplified, disposable intermediary passage for the adhesive through the dispensing tip coupled with the pump. This liner comprising non-adhesive reactive, disposable material is captive and supported by the shell of the quick change micro tip 14. Therefore, the liner does not require the strength necessary in tips currently available but incorporates the disposability necessary for cost reduction and rapid change overs between operations.

Figure 9:
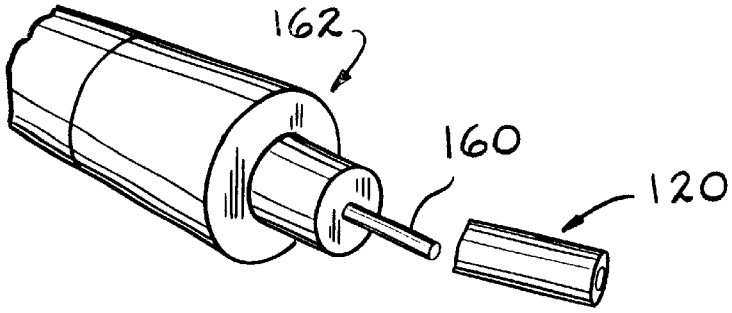
FIG. 9 is a perspective view illustrating one stage in the installation of the seal/liner of the present invention in the quick change tip of the present invention.
Figure 10:
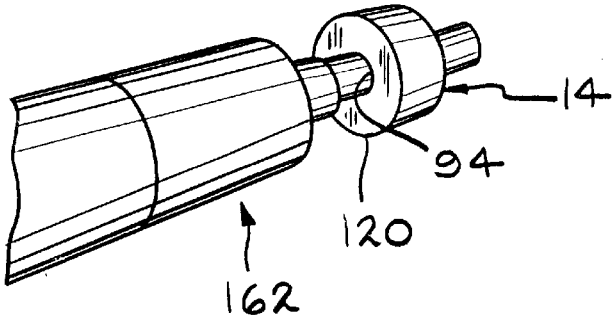
FIG. 10 is a perspective view illustrating another stage in the installation of the seal/liner of the present invention in the quick change tip of the present invention.

FIGS. 9 and 10 illustrate installation of the quick tip seal/liner 120 of the present invention on the tip 14. First, the smooth shaft 160 of a tip seal insertion/removal tool 162 is inserted into the seal/liner 120 as illustrated in FIG. 9. Seal 120 is substantially cylindrical in shape and shaft 160 is of a diameter such that it fits into the internal passage 126 of seal 120. The seal/liner 120 is lightly lubed with Mangalube grease or the equivalent for ease in seal insertion. Using the tip seal insertion/removal tool 162, one carefully pushes the seal 120 into the bottom of the central region 94 of the quick change dispensing tip 14 and then further into the central region 96 as shown in FIG. 10. Tool 162 is provided with two grooves (not shown) which fit over the retention pins 104, 106 on quick change tip 14. Next the tip seal insertion/removal tool 162 is pulled out of the quick change tip 14. One can determine that the quick change tip seal 120 is installed correctly by observing that a small portion of the seal 120 is visible in the base of the larger bore of quick change tip 14.

Figure 11:
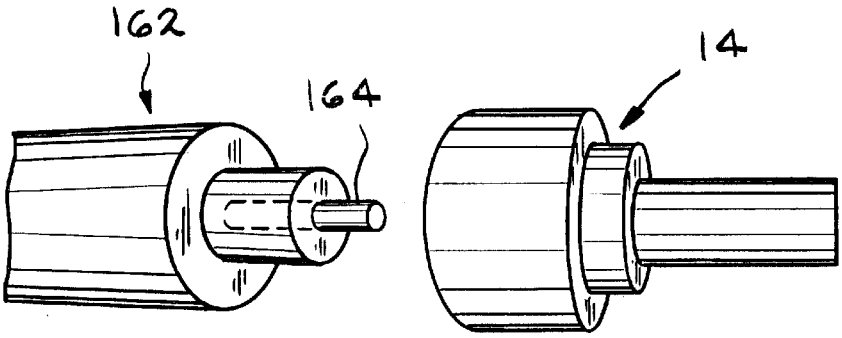
FIG. 11 is a perspective view illustrating removal of the seal/liner of the present invention from the quick change tip of the present invention.

FIG. 11 illustrates removal of seal 120 from tip 14. First a barbed end 164 of tool 162 is pushed carefully into the end of the internal passage 126 of quick change seal 120 located within the quick change tip 14. The two aforementioned grooves located on tool 162 will fit over the retention pins 104, 106 in the larger bore of tip 14. A slight rotation may be required to engage the pins in the grooves. Next the tip seal insertion/removal tool 162 is pulled directly out from the quick change tip 14. The tool 162 should not be rotated during this extraction. Then the quick change seal 120 can be removed from the insertion/removal tool 162 by pulling seal 120 off the barbed end 164. Cutting the seal from the tool 162 may change the barbs on end 164 for future use.

Tool 162 is shown in further detail in FIGS. 12–14 and includes a substantially cylindrical body portion 170 which can be provided with knurled regions 172 and 174 to facilitate gripping by hand. Smaller diameter portions 176 and 178 of shorter axial length are provided at opposite axial ends of body portion 170. The aforementioned grooves to receive pins 104, 106 are provided on portions 176, 178. In particular, sets of diametrically opposite grooves 180 and 182 are provided on portion 176 and sets of diametrically opposite grooves 184 and 186 are provided on portion 178. The aforementioned rod 160 projects axially from end portion 178. Portion 176 can be provided with a recess 188 having internal formations such as grooves, ridges or the like (not shown)to provide a similar function to that of the aforementioned barbed end 164 to enhance the functional grip of portion 176 when it is inserted onto the end of liner/seal 120.

Figure 15:
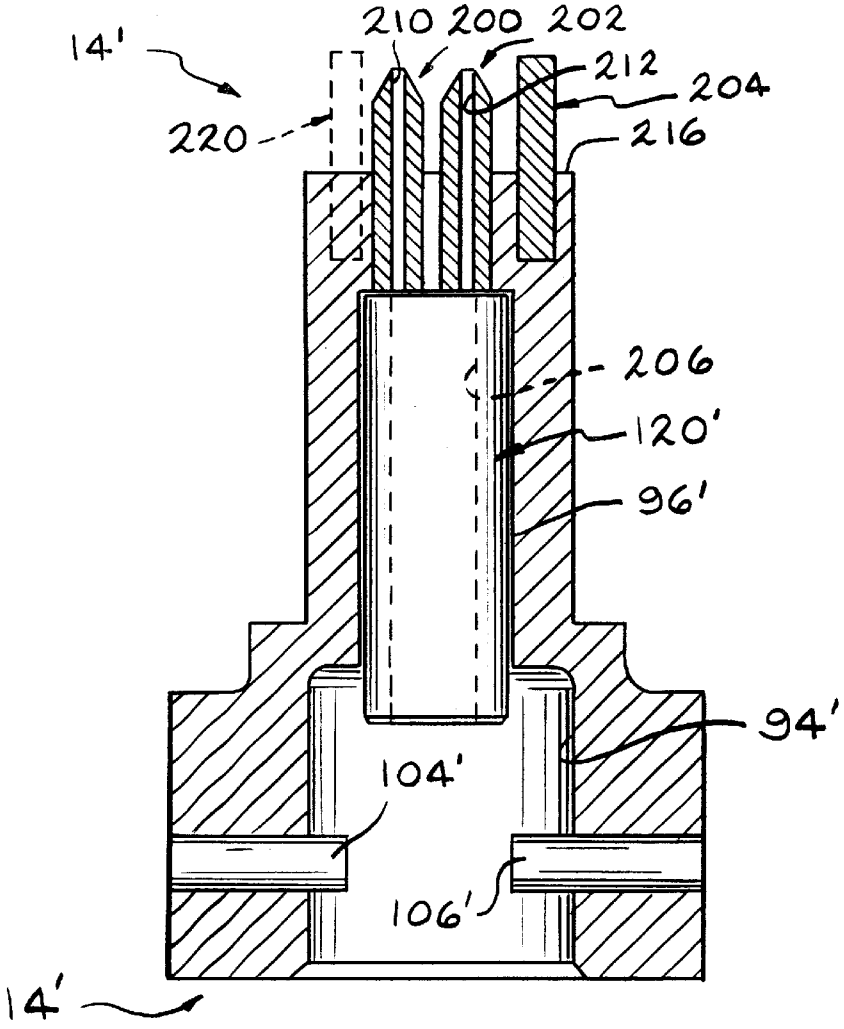

FIG. 15 illustrates an alternative form of dispensing tip 14' including a pair of nozzles 200 and 202 and a single foot or standoff 204. In this embodiment the seal/liner 120' has a relatively larger diameter internal passage 206 to provide fluid communication with the inner passages 210 and 212 of nozzles 200 and 202, respectively. In contrast to the integrally formed standoffs 110 and 112 in the embodiment of FIG. 5, standoff 204 of this embodiment is in the form of a pin or bar fixed in an opening provided in the end surface 216 of tip 14'. If desired, a second standoff 220 can be provided as shown in broken lines in FIG. 15. In addition, standoff 204, as well as standoff 220, in this embodiment could be formed integrally in the end of tip 14' in a manner similar to that of the embodiment of FIG. 5. Likewise, standoffs 110, 112 in FIG. 5 could be in the form of pins or bars fixed in openings provided in the end surface of tip 14.

Figure 16:
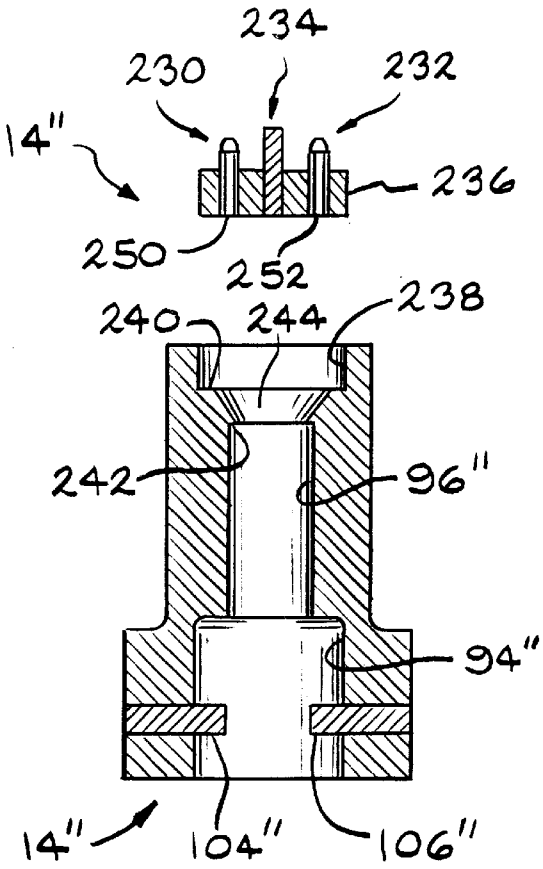
FIGS. 15 and 16 illustrate alternative forms of the quick change tip according to the present invention.

FIG. 16 illustrates another alternative form of dispensing tip 14" wherein a pair of nozzles 230 and 232 and a single centrally located standoff 234 are fixed in a base 236 which, in turn, fits into a recess 238 formed in the end of dispensing tip 14'. Base 236 contacts a first annular seat 240 formed in the body of tip 14". A second annular seat 242 contacts the end of the seal/liner (not shown) when it is installed in tip 14". This defines an open region 244 between the end of the seal/liner and the inner passages 250 and 252 of nozzles 230 and 232, respectively, to provide fluid communication between the central passage of the seal/liner and the nozzle passages 250, 252.

The flexibility of the material of the seal/liner 120 allows dispensing tip 14 to be provided with an actuator designated 260 in FIG. 5 which can be incorporated in the wall defining internal region 96 to apply lateral force to seal/liner 120 as viewed in FIG. 5 to compress and even close the internal passage 126. Operation of actuator 260 thus can control the flow volume in a valve-like action and even shut-off the flow if desired. Actuator 260 can be mechanically or fluid operated to apply force to the outer surface of the body of seal/liner 120 under control of a suitable controller 262 connected in controlling relation thereto.

It is therefore apparent that the present invention accomplishes its intended objectives. While several embodiments of the present invention have been described in detail, that has been done for the purpose of illustration, not limitation.

What is claimed is:

1. A micro dispensing tip assembly for use with precision dispensing apparatus for delivering controlled micro amounts of fluid to a selected location on a surface comprising:

a) an adapter having a longitudinal axis substantially parallel to flow of fluid therethrough and having a passage therethrough for connection at one end to said dispensing apparatus so that said passage is in fluid communication with an outlet of said apparatus;

b) a dispensing tip having a longitudinal axis substantially parallel to flow of fluid therethrough and substantially parallel to the longitudinal axis of said adapter when said adapter and said dispensing tip are connected together, said dispensing tip comprising a body having opposite ends and an interior region defined by an inner surface extending axially inwardly from one of said ends, said tip including a dispensing nozzle at the other of said ends of said body and provided with an internal passage and an outlet in communication with said internal passage, said tip further comprising a foot extending from the other of said ends of said body and located adjacent said nozzle, said foot extending slightly axially beyond said nozzle outlet, said foot being adapted to contact the surface on which fluid is to be delivered so that a micro quantity of fluid can leave said nozzle outlet and be delivered to the surface;

c) a liner body of material removably fitted in said interior region of said dispensing tip and in contact with said inner surface, said liner body having an unobstructed internal passage therethrough and in fluid communication with said interior region of said dispensing tip and with the internal passage of said nozzle, said liner body being of a material selected to be non-reactive with and impervious to the fluid being dispensed;

d) means on said adapter and on said dispensing tip for releasably coupling said adapter and said dispensing tip together so that an end of said dispensing tip opposite said nozzle is adjacent another end of said adapter and said passage of said adapter is in fluid communication with said internal region of said dispensing tip; and e) so that the liner can be removed and replaced thereby avoiding the need to clean the fluid from the tip interior region.

2. Apparatus according to claim 1, wherein said material of said liner body is selected to have sufficient flexibility so as to be in sealing relation with said interior region of said dispensing tip.

3. Apparatus according to claim 2, wherein said liner body contacts a surface of said adapter in sealing relation therewith when said adapter and said dispensing tip are coupled together.

4. Apparatus according to claim 2, wherein said liner body is elongated and said liner body internal passage extends longitudinally thereof and further including an actuator in said dispensing tip for applying lateral force to said body so as to vary the diameter of said liner body internal passage along a portion of the length thereof and a controller for controlling the operation of said actuator.

5. Apparatus according to claim 1, wherein said nozzle outlet has a diameter ranging from about 0.003 inch to about 0.033 inch.

6. Apparatus according to claim 1, wherein said nozzle has an end and said foot has an end and wherein the distance between a plane passing through the end of said nozzle and a plane coincident with the end of said foot ranges from about 0.003 to about 0.020 inch.

7. A micro dispensing tip assembly for use with precision dispensing apparatus for delivering controlled micro amounts of fluid to a selected location on a surface comprising:

a) an adapter having a longitudinal axis substantially parallel to flow of fluid therethrough and having a passage therethrough for connection at one end to said dispensing apparatus so that said passage is in fluid communication with an outlet of said apparatus;

b) a dispensing tip having a longitudinal axis substantially parallel to flow of fluid therethrough and substantially parallel to the longitudinal axis of said adapter when said adapter and said dispensing tip are connected together, said dispensing tip comprising a body defining an interior region and including a dispensing nozzle at one end of said body provided with an internal passage in communication with said internal region and an outlet in communication with said internal passage, said tip further comprising a foot extending from said one end of said body and located adjacent said body, said foot extending slightly axially beyond said nozzle outlet, said foot being adapted to contact the surface on which fluid is to be delivered so that a micro quantity of fluid can leave said nozzle outlet and be delivered to the surface;

c) at least one pin on said dispensing tip and extending substantially perpendicular to the longitudinal axis of said dispensing tip; and d) at least one groove in said adapter of a size to receive said pin and having a first portion extending in a direction substantially parallel to the longitudinal axis of said adapter and having a second portion of shorter length than said first portion and extending at an angle to said first portion;

e) so that said dispensing tip can be releasably connected to said adapter by moving said dispensing tip longitudinally to cause said pin to move along said first portion of said groove and then rotating said dispensing tip about the longitudinal axis thereof to move said pin along said second portion of said groove.

8. Apparatus according to claim 7, wherein said adapter and said dispensing tip each have a substantially cylindrical shape and further including another pin on said dispensing tip diametrically apposite the first-named pin and another groove in said adapter diametrically opposite the first-named groove.

9. Apparatus according to claim 7, wherein said nozzle outlet has a diameter ranging from about 0.003 inch to about 0.033 inch.

10. Apparatus according to claim 7, wherein said nozzle has an end and said foot has an end and wherein the distance between a plane passing through the end of said nozzle and a plane coincident with the end of said foot ranges from about 0.003 inch to about 0.020 inch.

11. A tool for installing a disposable liner in a dispensing tip for use with precision dispensing apparatus for delivering controlled amounts of fluid to a selected location, said dispensing tip having a body defining an interior region and including a dispensing nozzle in said body provided with an internal passage and an outlet in communication with said internal passage, said disposable liner comprising a body shaped and sized to be received snugly but removably in said interior region of said dispensing tip and having an internal passage adapted to be in fluid communication with said internal passage of said nozzle when said liner is installed in said dispensing tip, said tool comprising:

a) a body having a portion adapted to be gripped by hand;

b) a rod-like formation extending from said body and having a cross-sectional dimension enabling it to fit into said internal passage of said liner; and c) so that said tool can be manipulated to urge said liner into said internal region of said dispensing tip and said tool can be removed from said liner after placement of said liner in said internal region of said dispensing tip.

12. A tool according to claim 11, wherein said dispensing tip includes at least one pin extending into an interior region of said dispensing tip for providing connection to an adapter associated with said dispensing apparatus and wherein said tool includes a slot located in relation to said rod-like formation for accommodating said pin when said tool is used to install said liner in said dispensing tip.

13. A tool according to claim 12, wherein diametrically opposed pins extend into said interior region of said dispensing tip and wherein corresponding diametrically opposed pin-accommodating slots are provided on said tool.

14. A tool according to claim 11 further including a formation extending from said body at a location spaced from said rod-like formation and shaped to grip said liner in frictional contact therewith for removing said liner from said dispensing tip.

15. A method for installing a dispensing tip assembly on a precision dispensing apparatus for delivering controlled amounts of fluid to a selected location comprising the steps of:

a. providing an adapter having a passage therethrough;

b. installing said adapter on said dispensing apparatus so that said passage is in fluid communication with an outlet of said apparatus;

c. providing a dispensing tip having an internal region and including a dispensing nozzle at one end of said tip provided with an internal passage and an outlet in communication with said internal passage;

d. inserting a liner body in said internal region of said dispensing tip so that an internal passage of said liner body is in fluid communication with said interior region of said dispensing tip and with said internal passage of said nozzle;

e. releasably coupling said dispensing tip to said adapter so that said internal region of said dispensing tip is in fluid communication with said passage of said adapter;

f. said step of inserting said liner body being performed using a hand tool having a formation thereon adapted to fit into said internal passage of said liner body.

16. A method for installing a dispensing tip assembly on a precision dispensing apparatus for delivering controlled amounts of fluid to a selected location comprising the steps of:

a. providing an adapter having a passage therethrough;

b. installing said adapter on said dispensing apparatus so that said passage is in fluid communication with an outlet of said apparatus;

c. providing a dispensing tip having an internal region and including a dispensing nozzle at one end of said tip provided with an internal passage and an outlet in communication with said internal passage;

d. inserting a liner body in said internal region of said dispensing tip so that an internal passage of said liner body is in fluid communication with said interior region of said dispensing tip and with said internal passage of said nozzle;

e. releasably coupling said dispensing tip to said adapter so that said internal region of said dispensing tip is in fluid communication with said passage of said adapter;

f. disconnecting and dispensing tip from said adapter; and removing said liner body from said dispensing tip to allow a new liner body to be installed in said dispensing tip;

h. said step of removing said liner body from said dispensing tip being performed using a hand tool having a formation thereon for frictionally gripping said liner body.

* * * * *